US005457875A

United States Patent [19]

Ohta et al.

[11] Patent Number: 5,457,875

[45] Date of Patent: Oct. 17, 1995

[54] CONNECTOR HOUSING POSITIONING UNIT

[75] Inventors: Yoshinobu Ohta; Kenichi Taniguchi, both of Yokkaichi, Japan

[73] Assignee: Sumitomo Wiring Systems, Ltd., Yokkaichi, Japan

[21] Appl. No.: 208,701

[22] Filed: Mar. 11, 1994

[30] Foreign Application Priority Data

Mar. 12, 1993 [JP] Japan ..... 5-052522

[51] Int. Cl.[6] ..... H01R 43/20

[52] U.S. Cl. ..... 29/747; 29/33 M; 29/748; 29/754; 29/760

[58] Field of Search ..... 29/33 M, 747, 29/748, 749, 754, 757, 759, 760, 845, 564.1; 269/50

[56] References Cited

U.S. PATENT DOCUMENTS

| | | | |
|---|---|---|---|
| 3,964,147 | 6/1976 | Fusco et al. | 29/754 X |
| 4,395,028 | 7/1983 | Kent | 269/50 |
| 4,395,818 | 8/1983 | Jackson | 29/759 X |
| 4,519,132 | 5/1935 | Kleinedler et al. | 29/747 X |
| 4,754,536 | 7/1988 | Goyert et al. | 29/748 X |
| 4,912,823 | 4/1990 | Shah et al. | 29/748 X |

FOREIGN PATENT DOCUMENTS

| | | | |
|---|---|---|---|
| 0413655 | 2/1991 | European Pat. Off. | 29/747 |
| 0448116 | 9/1991 | European Pat. Off. . | |
| 63-174224 | 7/1988 | Japan . | |
| 63-116920 | 7/1988 | Japan | 29/747 |
| 63-117088 | 7/1988 | Japan | 29/747 |
| 63-123082 | 8/1988 | Japan . | |
| 63-200416 | 8/1988 | Japan | 29/748 |
| 63-314716 | 12/1988 | Japan | 29/748 |

*Primary Examiner*—Peter Vo

*Attorney, Agent, or Firm*—Beveridge, DeGrandi, Weilacher & Young

[57] ABSTRACT

A connector housing positioning unit includes a holding member for holding connector housings, a locking member for locking corresponding connector housings to the holding member, a shifting member for shifting the locking member between a clamping position for clamping the connector housing and a releasing position for releasing the connector housing, and a mounting member detachably fixed to a connector housing feeding apparatus that feeds the connector housings to a terminal inserting mechanism, for integrally carrying the holding member, locking member and shifting member.

16 Claims, 5 Drawing Sheets

CONNECTOR HOUSING POSITIONING UNIT

CROSS REFERENCE TO RELATED APPLICATION

This application claims priority benefits under 35 U.S.C. Section 119 based on Japanese Patent Application Serial No. 5-52522, the disclosure of which is incorporated herein by reference.

BACKGROUND OF THE INVENTION

1. Field of the Invention

The present invention relates to a connector housing positioning unit. More particularly, the present invention relates to a connector housing positioning unit for positioning connector housings in predetermined positions in order to insert terminals fixed to ends of electric wires to the connector housing in manufacturing of a wire harness.

2. Description of the Related Art

Generally, a wire harness employed in an automobile and the like is an electric wiring system composed of a bundle of plural electric wires that are cut to a predetermined dimension. A manufacturing process of such a wire harness includes the steps of measuring and cutting electric wires to a predetermined length, stripping insulating sheaths at the ends of the wires cut to a the predetermined length, crimping crimp terminals to stripped core at the ends of wires, inserting the crimped terminals to a connector housing and bundling the wires connected to the connector housing.

The steps for manufacturing wire harnesses are being automated for the purpose of such rationalizations as reduction in time and cost required for producing a wire harness. Specifically, in the step of inserting a terminal, various automatic apparatuses are proposed for automatically inserting a terminal into a connector housing.

Japanese Laid-Open Patent No. 63-174224, for example, discloses a terminal inserting apparatus for inserting terminals to connector housings Juxtaposed in a predetermined direction with spaces therebetween. In a practical application of such a terminal inserting apparatus, it is required to provide a connector housing feeding apparatus for positioning connector housings placed side by side, and feeding the juxtaposed connector housings to the terminal inserting apparatus.

In such a connector housing feeding apparatus, a high efficiency and versatility that provide an applicability to various types of wire harnesses are demanded in these days. In other words, wire harnesses are different in the number of connectors and circuits depending on their particular product applications. In addition, the more complicated the wiring of a particular product is then the greater it would be to use a variety of connector housings. Thus, a connector housing feeding apparatus for efficiently and versatilely producing various wire harnesses is demanded.

Conventional connector housing feeding apparatuses, however, are for specific applications, and insufficient in such efficiency and versatility.

A connector housing feeding apparatus disclosed in Japanese Laid-Open Patent No. 63-314716, for example, employs the following structure. A stationary member of the connector housing feeding apparatus has a mounting member formed integrally therewith. A holder for a connector housing is exchangeably attached to the mounting member.

On the other hand, the stationary member is provided with a locking member for releasably locking the holder and a driving mechanism for driving the locking member. Then, a positioning unit is composed of the mounting member, holder, locking member and driving mechanism.

In the foregoing conventional conector housing feeding apparatus, because the holder is attached to the mounting member of the stationary member, the holder would be exchanged more and more as more types of connector housings are used. Naturally, such increase of replacements restricts a versatility and efficiency of the connector housing feeding apparatus.

In addition to the above example of prior art, other connector housing feeding apparatuses are disclosed in Japanese Laid-Open Utility Patent Nos. 63-116920, 63-117088 and 63-123082, and Japanese Laid-Open Patent No. 63-200416. One each connector housing feeding apparatus is provided with a turntable which revolves about a vertical axis. Plural groups of connector housing positioning mechanisms are employed in each side of the turntable for positioning connector housings in directions crossing the rotational axis of the turntable. The positioning mechanism comprises plural holders formed integrally with the turntable and a locking member cooperating with the holder for holding a corresponding connector housing. The positioning mechanism is alternately conveyed to a connector housing loading/unloading position and terminal inserting position by the turntable.

The latter connector housing feeding apparatus is superior to the former. Because the connector housing positioning mechanism is carried to the connector housing loading/unloading position and terminal inserting position by means of the turntable, feeding of connector housings from a connector housing supply to the terminal inserting position is facilitated, thereby, providing higher reliability and efficiency.

Nevertheless with latter connector housing feeding apparatus, it is also hard to attain a versatility of the apparatus or the turntable because the holder is integrally formed with the turntable in the positioning mechanism.

Therefore, what is really needed is a connector housing positioning unit that composes a connector housing feeding apparatus with high efficiency and versatility.

SUMMARY OF THE INVENTION

The invention is directed to a connector housing positioning unit that satisfy this need. In a preferred mode of the invention, connector housings are clamped by holders and locking members, upon being juxtaposed in a predetermined direction. The locking members are connected with a common link member. Means for driving the link member is employed in the connector housing positioning unit of the invention. The holders, the locking members, the link member, and the means are fixed to a mounting member. The mounting member is detachably fixed to a connector housing feeding apparatus that delivers a connector housing between a loading/unloading position and a terminal inserting position. In such manner, a unit can be composed of all parts that are required for positioning and are attached to the mounting member. The versatility of the connector housing feeding apparatus is increased, because the connector housings corresponding to various types of wire harnesses can be supplied by exchanging the unit.

In a more preferred mode of the invention, the holders are located in opposition to the locking members along a juxtaposing direction of the connector housings for clamping the connector housings in the direction. Thus, the driving members for driving the locking members are arranged and driven along the juxtaposing direction, the positioning unit is reduced in size, thereby avoiding an adverse effect on the feeding function of the connector housing feeding apparatus.

The above and other objects, features and effects of the invention will become apparent by reading the detailed description of an embodiment, and referring to the attached drawings.

DESCRIPTION OF PREFERRED EMBODIMENTS

Figure 1:
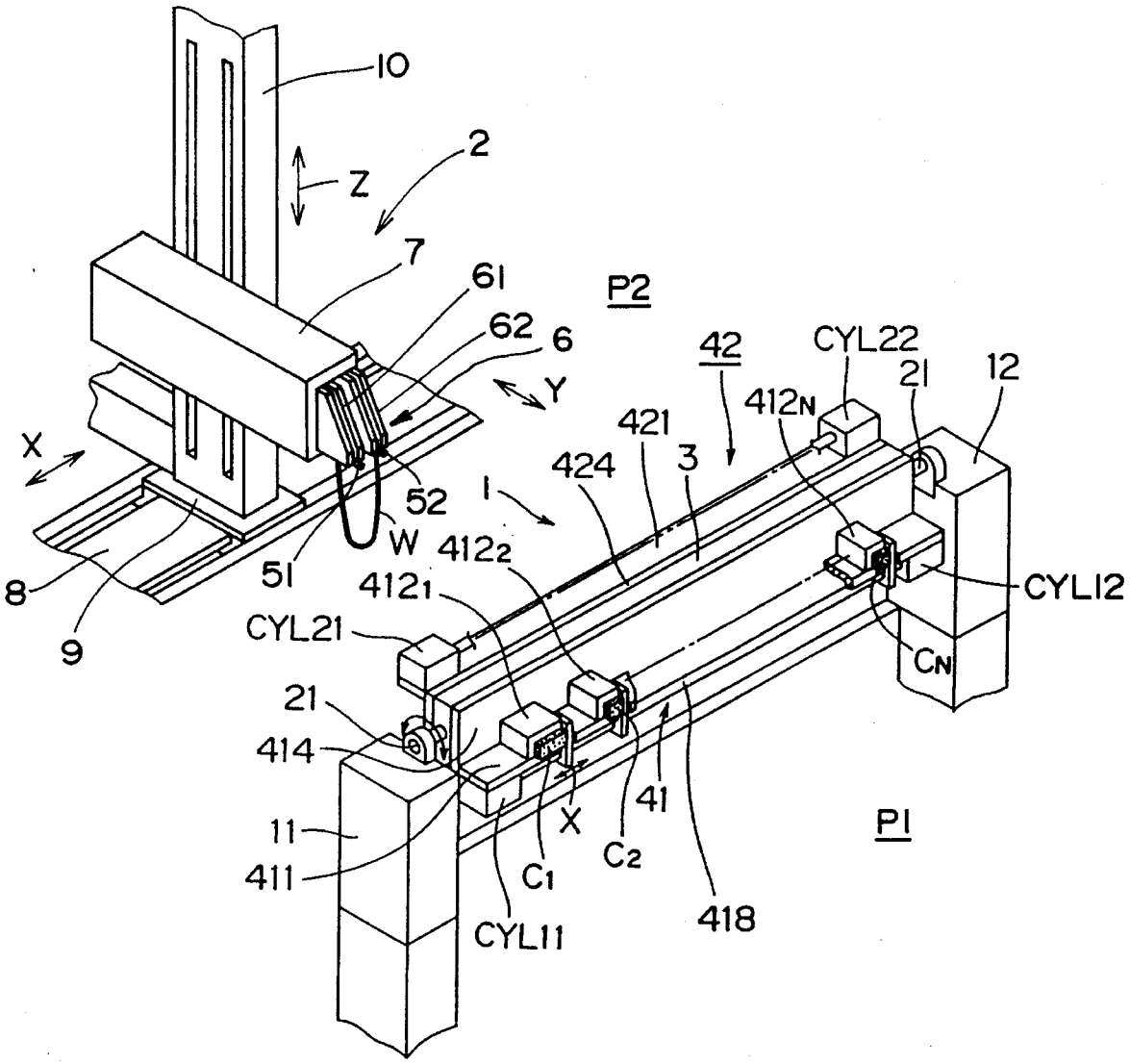
FIG. 1 is a perspective view showing a connector housing feeding apparatus with a connector housing positioning unit according to an embodiment of the invention and a terminal inserting apparatus controlled in association with the feeding apparatus.

FIG. 1 is a connector housing feeding apparatus according to an embodiment of the invention and a terminal inserting apparatus controlled in association with the feeding apparatus. In the figure, the connector housing feeding apparatus is depicted by reference numeral 1, and the terminal inserting apparatus by 2.

The connector housing feeding apparatus 1 is provided for delivering plural connector housings $C_1$, $C_2$ . . . and $C_N$ between a predetermined connector housing loading/unloading position P1 and terminal inserting position P2. The connector housing feeding apparatus 1 comprises stationary members 11, 12 uprightly placed on a floor (not shown), a longitudinal rotating plate 3 supported rotatively about a horizontal support shaft 21 by the stationary members 11, 12, and a pair of positioning units 41, 42 respectively employed in front and back surfaces of the rotating plate 3 for positioning plural connector housings $C_1$ to $C_N$. The connector housings $C_1$ to $C_N$ are loaded to one of the positioning units 41, 42 at the connector housing loading/unloading position P1. Then, the rotating plate 3 is rotated 180° about the support shaft 21 by rotating means not shown. By repetitively conducting the operation, the connector housings $C_1$ to $C_N$ loaded to the positioning unit 41 (42) can be carried to the terminal inserting position P2, and come in opposition to the terminal inserting apparatus 2.

Figure 3:
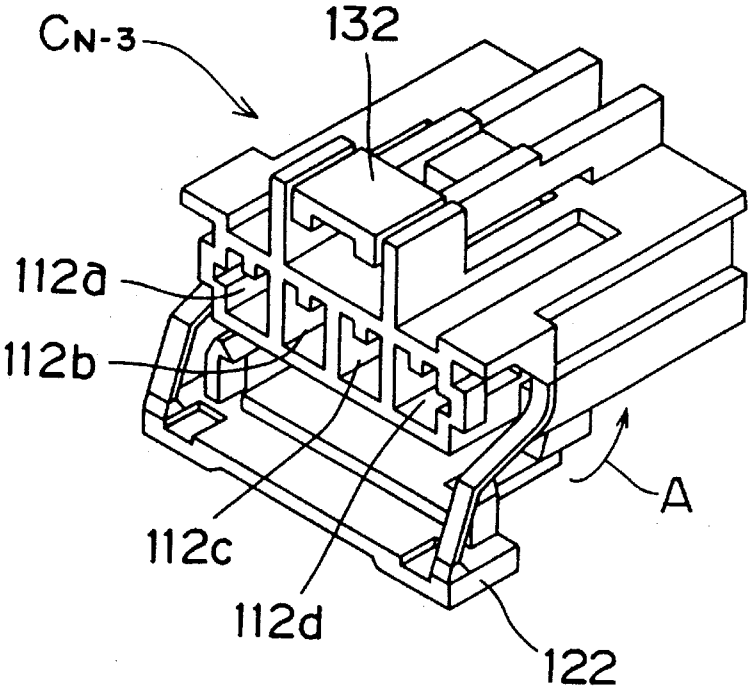
FIG. 3 PRIOR ART
FIGS. 2 and 3 are perspective views showing an example of a connector housing.
Figure 2:
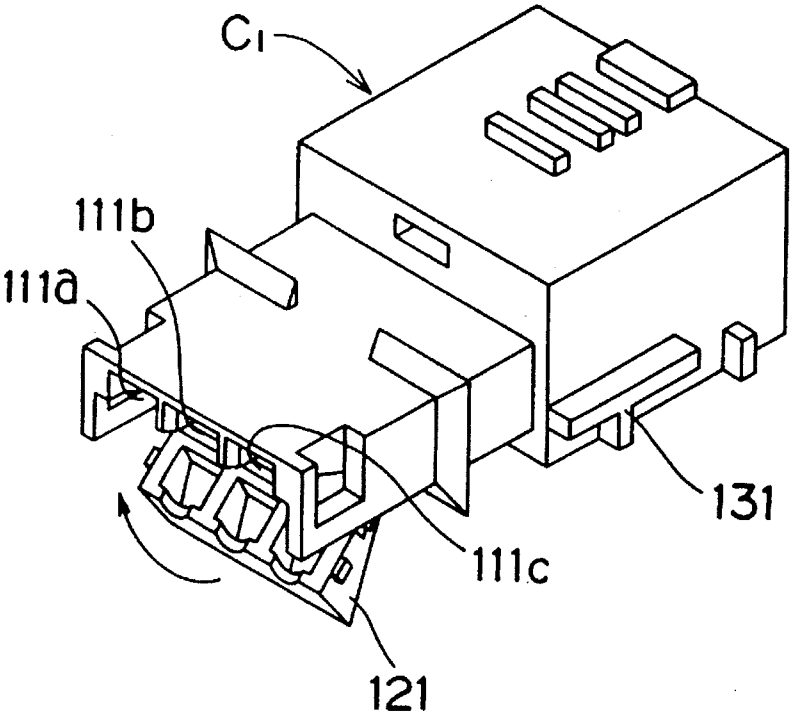
FIG. 2 PRIOR ART

All connector housings $C_1$ to $C_N$ fed by the connector housing feeding apparatus are of a structure conventionally known. As illustrated in FIGS. 2 and 3, each of the connector housings $C_1$ to $C_N$ has plural terminal holes for receiving terminals that are inserted thereto. The connector housing $C_1$ shown in FIG. 2 is provided with a presser member 121 opening or closing a lower inlet part of the terminal holes 111*a*, 111*b*, 111*c* for preventing the terminals from being removed by pressing terminal barrels, when closed, and an anchor member 131 generally formed in a T shape, and projected from the main body in a side surface.

On the other hand, the connector housing $C_{N-3}$ of FIG. 3 is provided with a notch (not shown) opening on a downstream side of terminal holes 112*a*, 112*b*, 112*c*, 112*d* in the inserting direction of, the terminal, and an anchor member 122 formed integrally with the main body. The anchor member 122 is displaced in the direction shown by an arrow A in FIG. 3, and inserted to the notch so as to press a leading end part of a terminal for preventing it from being removed from the connector housing. A part projecting from an upper surface of the main body is a retainer projection 132.

In the following, by referring to FIGS. 4 to 6, the positioning units 41, 42 for the connector housings $C_1$ to $C_N$ are described in detail.

The first and second positioning units 41, 42 are placed in point symmetrical relation with each other about the support shaft 21. Therefore, when one of the units is in the connector housing loading/unloading position P1, the other is located in the terminal inserting position P2.

The first positioning unit 41 comprises a base plate 411 extended along the support shaft 21 of the rotating plate 3, plural holders $\mathbf{412}_1$, $\mathbf{412}_2$, $\mathbf{412}_3$, . . . $\mathbf{412}_{N-3}$, $\mathbf{412}_{N-2}$, $\mathbf{412}_{N-1}$, and $\mathbf{412}_N$ spaced with each other by a predetermined distance, and juxtaposed in the longitudinal direction of the base plate 411 or along the axial direction of the support shaft 21 for holding the connector housings $C_1$ to $C_N$, and plural locking arms $\mathbf{413}_1$, $\mathbf{413}_2$, $\mathbf{413}_3$, . . . $\mathbf{413}_{N-3}$, $\mathbf{413}_{N-2}$, $\mathbf{413}_{N-1}$, and $\mathbf{413}_N$for pressing a side surface of the connector housings contained respectively in the holders $\mathbf{412}_1$ to $\mathbf{412}_N$, and locking them to corresponding holders $\mathbf{412}_1$ to $\mathbf{412}_N$.

A back plate 414 is formed as an elongated plate corresponding to the base plate 411. The base plate 411 and back plate 414 are assembled so as to form an L shape in their end surfaces (FIG. 6), and detachably fixed by a coupling member (a bolt, for example). As clearly shown in FIGS. 1 and 6, the surfaces coupled at a right angle to each other form a positioning surface for positioning the connector housings $C_1$ to $C_N$ by cooperating with the holders $\mathbf{412}_1$ to $\mathbf{412}_N$. A seat surface 411*a* of the base plate 411 composing the positioning surface is set so as to be located in the upper side, when it is placed at the connector housing loading/unloading position P1. This allows the connector housings $C_1$ to $C_N$ to be sequentially loaded, as they are put on the surface 411*a*, and provides with an advantage of a higher operability.

Figure 4:
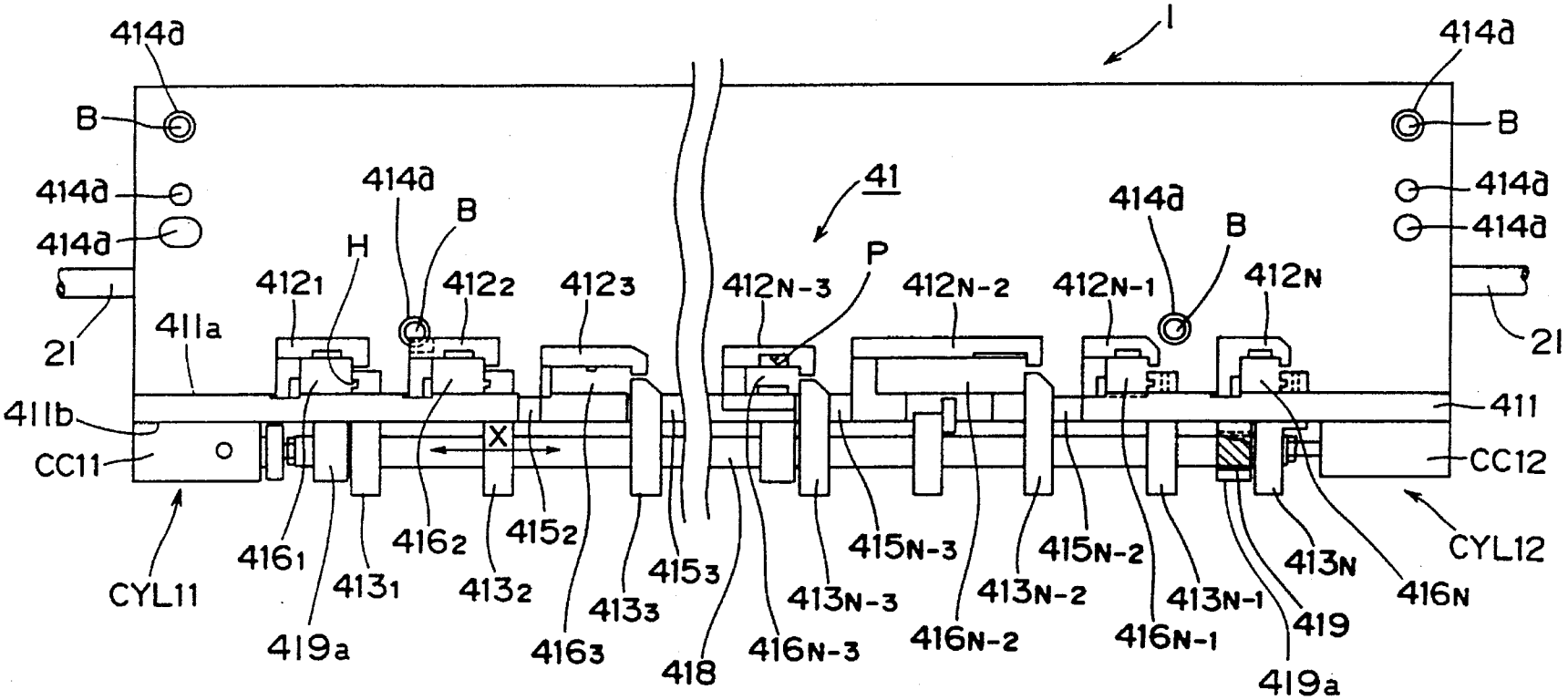
FIG. 4 is a front view showing the main parts of the connector housing positioning unit.
Figure 5:
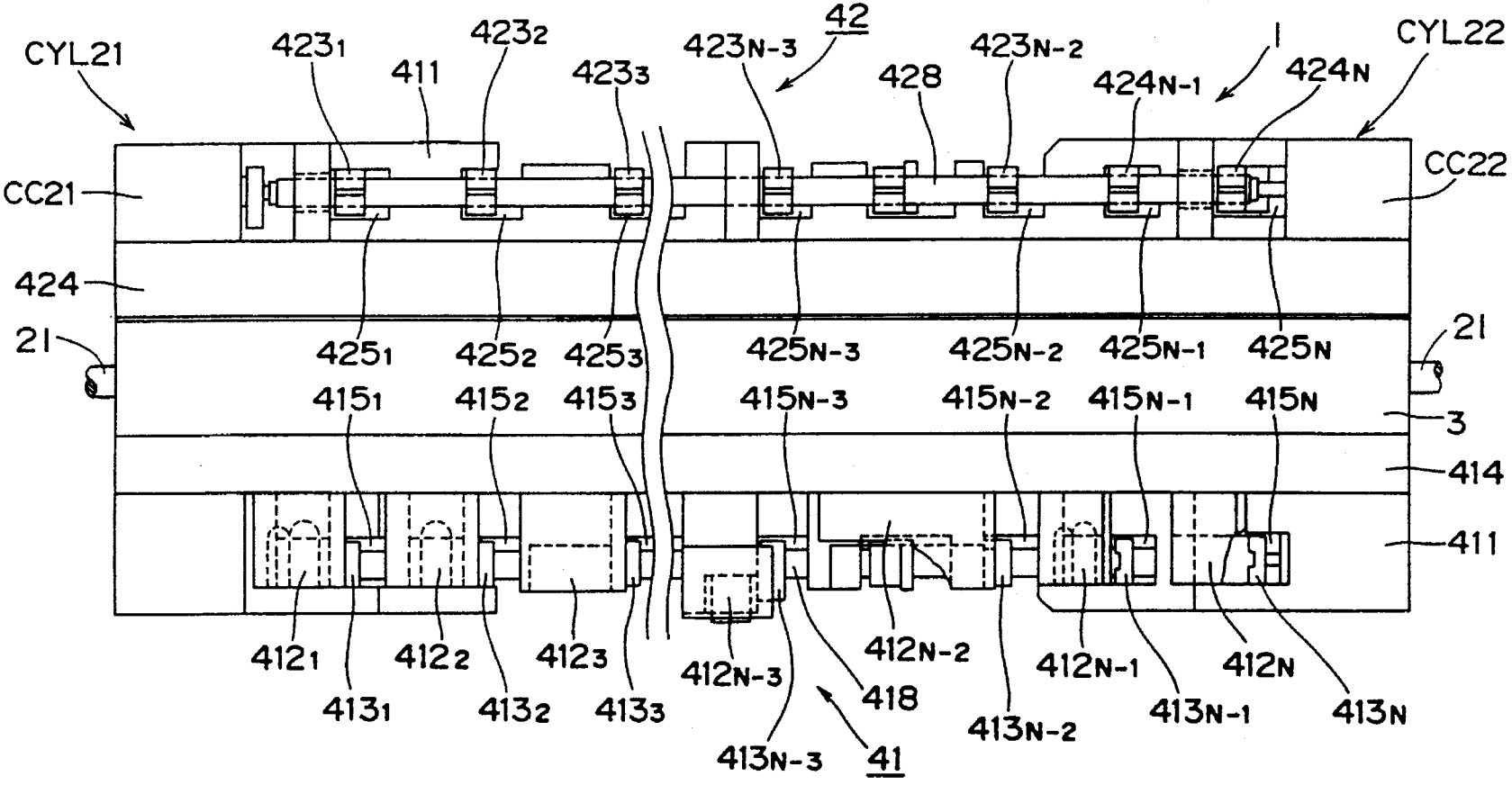
FIG. 5 is a plan view showing the main parts of the connector housing positioning unit.

As shown in FIG. 4, plural positioning holes 414*a* are employed through the back plate 414 at predetermined positions. A bolt B is inserted through the positioning hole, and the back plate 414 is fixed to the rotating plate 3 by the bolt B. Because of such arrangement, the back plate 414 is detachable from the rotating plate 3.

The holders $\mathbf{412}_1$ to $\mathbf{412}_N$ are formed generally in a hook-like shape with an upright part vertically situated in the resting surface 411*a* of the base plate 411, and a horizontal part extending in one direction (toward the right side of FIG. 4, in the embodiment) from an upper end of the upright part along the axis of support shaft 21. The holders $\mathbf{412}_1$ to $\mathbf{412}_N$ in conjunction with the seat surface 411*a* form inlets $\mathbf{416}_1$, $\mathbf{416}_2$, $\mathbf{416}_3$, . . . $\mathbf{416}_{N-3}$, $\mathbf{416}_{N-2}$, $\mathbf{416}_{N-1}$, and $\mathbf{416}_N$. The inlets $\mathbf{416}_1$ to $\mathbf{416}_N$ serve for respectively receiving connector housings $C_1$ to $C_N$ in the horizontal direction perpendicular to the support shaft 21. In an inner wall of each of the holders $\mathbf{412}_1$ to $\mathbf{412}_N$ sectioning the inlets $\mathbf{416}_1$ to $\mathbf{416}_N$, a projection following a shape of corresponding connector housing is formed. In the holder $\mathbf{412N}_3$, for example, a projection P is formed for preventing a connector housing contained therein from being removed by engaging with the retainer projection 132 illustrated in FIG. 3.

The locking arms $413_1$, $413_2$, $413_3$, . . . $413_{N-3}$, $413_{N-2}$, $413_{N-1}$, and $413_N$ are placed in an open side of the holders $412_1$ to $412_N$, or a leading end side of the horizontal part. A surface of the locking arms $413_1$ to $413_N$ pressing the connector housing or in opposition to the upright part of the holders $412_1$ to $412_N$ is formed with a projection following a side configuration of the corresponding connector housing. For example, the locking arm $413_1$ is formed with an engagement recess H for engaging with the anchor member 131 illustrated in FIG. 2.

In order to attach the locking arms $413_1$ to $413_N$ to the base plate 411, the base plate 411 is provided with notches $415_1$, $415_2$, $415_3$, . . . $415_{N-3}$, $415_{N-2}$, $415_{N-1}$, and $415_N$ which are spaced with each other by a predetermined width, and the locking arms $413_1$ to $413_N$ are inserted through the notches $415_1$ to $415_N$, and projected beneath the base plate 411 at the connector housing loading/unloading position P1. The notches $415_1$ to $415_N$ are dimensioned to such width that the corresponding locking arms $413_1$ to $413_N$ are allowed to be displaced along the support shaft 21 in the axial direction. Thus, the locking arms $413_1$ to $413_N$ are capable of clamping and releasing the connector housings by displacing along the juxtaposing direction of the connector housings, and cooperating with corresponding holders.

In the seat surface 411*a* and opposite surface for a lower surface of the base plate 411 in the connector housing loading/unloading position P1) 411*b*, a shifting mechanism is employed for integrally reciprocating the locking arms $413_1$ to $413_N$ along the support shaft 21.

The shifting mechanism comprises, as shown in FIG. 4, a common rod 418 coupled with the locking arms $413_1$ to $413_N$ and a pair of cylinders CYL11, CYL12 combined with the rod 418 in either ends thereof. The rod 418 is supported on the base plate 411 through a bushing 419 by a bearing 419*a*. A cylinder cap CC11 of the cylinder CYL11 is attached to an end part of the lower surface 411*b*, and a cylinder cap CC12 of the cylinder CYL 12 is attached to the other end part of the lower surface 411*b*. When the cylinder CYL11 is pulled, or the cylinder CYL12 pushed, the rod 418 slides to the left in FIG. 4, and the locking arms $413_1$ to $413_N$ are moved integrally along the Juxtaposing direction of the connector housings to a clamping position (shown in FIG. 4) for clamping the connector housings. As a result, the locking arms $413_1$ to $413_N$ are abutted to a right side surface of the connector housings contained in the holders $412_1$ to $412_N$, and presses them into the corresponding holders $412_1$ to $412_N$. On the other hand, when the cylinder CYL11 is pushed, or the cylinder CYL12 pulled, the locking arm $413_1$ to $413_N$ are moved to a releasing position for releasing the connector housings contained in the holders $412_1$ to $412_N$.

Figure 6:
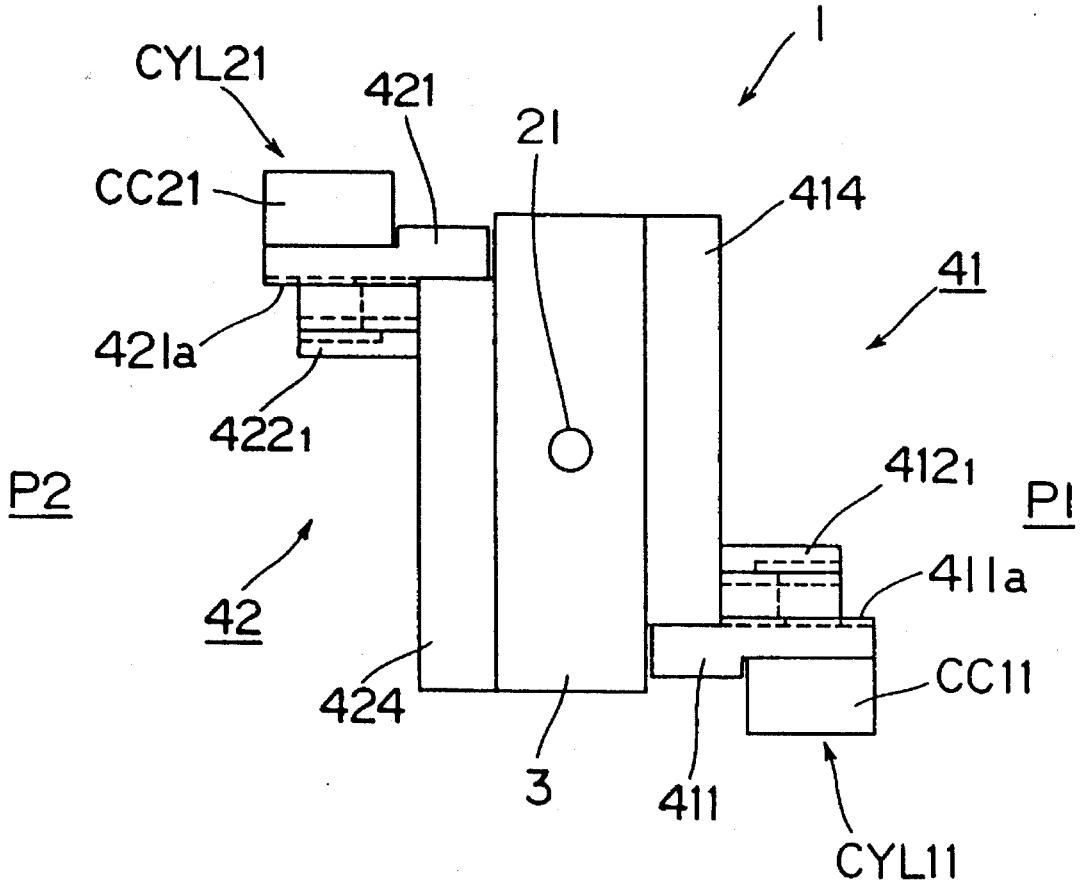
FIG. 6 is a side view showing the main parts of the connector housing positioning unit.

The second positioning unit 42 has a structure similar to that of the first positioning unit 41, and comprises a base plate 421, holders $422_1$ to $422_N$ (only the holder $422_1$ is shown in FIG. 6), locking arms $423_1$ to $423_N$, a rod 428 and cylinders CYL21, CYL22. In the figure, reference numerals $425_1$ to $425_N$ are notches, and CC21, CC22 cylinder caps.

The terminal inserting apparatus 2 comprises an inserting head 6 having a first clamp 61 for clamping a barrel of a terminal 51 that is fixed to an end of an electric wire W by pressure and a second clamp 62 for clamping a barrel of a 10 terminal 52 fixed to the other end of the electric wire W; an X rail 8 fixed to a floor, and extending in the direction along the support shaft 21 (hereinafter referred to as "direction X"); a moving member 9 reciprocatively provided along the X rail 8; and a Z rail 10 projected from the moving member 9 for vertically (hereinafter referred to as "in the direction Z") guiding an arm 7 that supports the inserting head 6, and serves for inserting the terminals 51, 52 to the connector housings $C_1$ to $C_N$. The inserting head 6 is reciprocated along the X rail 8 and Z rail 10. Accordingly, the inserting head 6 can be positioned in opposition to a predetermined Connector housing that is fed to the terminal inserting position P2 by the connector housing feeding apparatus 1. In such state, the first clamp 61 is projected in the horizontal direction (hereinafter "direction Y") perpendicular to the direction X, and the terminal 51 is inserted to a predetermined connector housing. Thereafter the inserting head 6 is shifted in the directions X and Y so as to be in opposition to another connector housing, the second clamp 62 is projected in the direction Y, and the terminal 52 is inserted to another connector housing.

In the connector housing feeding apparatus 1 described above, firstly, the connector housings $C_1$ to $C_N$ are loaded and fixed to the holders of the positioning unit that is located in the connector housing loading/unloading position P1. Then, as shown in FIG. 1, the rotating plate 3 is rotated 180° about the support shaft 21, and the positioning unit carrying the connector housings comes in opposition to the terminal inserting apparatus 2 for inserting terminals. By such rotating operation, the other positioning unit is shifted from the terminal inserting position P2 to the connector housing loading/unloading position P1.

In succession, the terminal inserting apparatus 2 starts inserting the terminals. While the terminals are inserted to the connector housings $C_1$ to $C_N$ positioned by one of the positioning units, connector housings are loaded and fixed to the other unit shifted to the connector housing loading/unloading position P1.

When the terminal inserting step and connector housing loading operation is completed, the rotating plate 3 is rotated 180° again, and the other positioning unit comes in opposition to the terminal inserting apparatus 2 for inserting terminals. The positioning unit that has completed the terminal inserting step is now returned to the connector housing loading/unloading position P1.

While terminals are inserted to the connector housings positioned by the other positioning unit (located at the position P2) the locking arms of the positioning unit in the position P1 are shifted to the releasing position, and the connector housings now combined with the wires are removed from the holders. Then, in the same manner as described above, connector housings are positioned in the first positioning unit 41, again.

In such arrangement, because the holders, locking arms and switching mechanism are attached to the base plate 411 (412) and back plate 414 (424) that are detachable to the rotating plate 3, the positioning mechanism is formed as a unit in relation to the connector housing feeding apparatus 1, and the detaching operation is thereby facilitated. Accordingly, it contributes to increasing the versatility and preparation efficiency of the connector housing feeding apparatus 1.

Moreover, as connector housings are clamped in either sides by the respective holders and locking arms along the juxtaposing direction thereof, components of the switching mechanism can be arranged, and shifted along the juxtaposing direction or the longitudinal direction of the base plate. As a result, even when a wide variety of connector housings are juxtaposed, the unit can be arranged in a relatively small size, and connector housings can be easily transported by the connector housing feeding apparatus.

In addition, since the locking arms are operated integrally by means of the common link member 418, connector housings contained in multiple holders can be loaded only by using two cylinders CYL11, CYL12.

Furthermore, because the back plate 414 is provided with plural positioning holes **414*a*, it can be easily detached from the rotating plate 3**, and the preparation time can be reduced. Therefore, by arranging the mounting member with plural types of holders for particular wire harnesses, the versatility is further increased.

Needless to say, the invention is not limited to the embodiment described above, and can be modified and changed within the scope of the invention.

In the embodiment, although the locking arms are displaced by integrally reciprocating plural locking arms by means of the cylinders, the plural locking arms may be simultaneously displaced by using a solenoid.

In addition, although the positioning unit for positioning the connector housings are attached to either sides of the rotating plate, the plural positioning units may be detachably fixed to an elevating plate that is attached movably in the vertical direction to the stationary member, so that terminals are inserted sequentially to the connector housings positioned in the positioning unit by elevating the elevating plate in the direction Z along the stationary member.

In the above embodiment, the mounting member includes the back and base plates. However, the mounting member may be the back plate only, or the base plate only.

Thus, the above embodiment is taken as only an example for clearly showing technical details of the invention, and the invention should not be understood narrowly as being limited to the embodiment alone. Hence, the spirit and scope of the invention are limited only by the attached claims.

We claim:

1. A connector housing positioning unit for positioning plural connector housings which are juxtaposed in a predetermined direction with spaces therebetween, wherein the connector housing positioning unit positions connector housings such that terminals fixed to ends of electric wires are inserted into the connector housings during manufacture of a wire harness, the connector housing positioning unit comprising:

holding means for holding the connector housings;

locking means for locking corresponding connector housings to the holding means;

shifting means for shifting the locking means between a clamping position for clamping the connector housings and a releasing position for releasing the connector housings; and mounting means for feeding the connector housings to a terminal inserting mechanism, wherein the connector housing positioning unit integrally carries the holding means, the locking means and the shifting means, wherein:

the holding means includes plural holders fixed to the mounting means along the predetermined direction;

the locking means includes locking arms placed in opposition to the respective holders along the predetermined direction; and the shifting means includes a common link member coupled with locking members of the locking means, wherein the shifting means shifts the locking members along the predetermined direction by means of the link member.

2. A connector housing positioning unit according to claim 1, wherein:

the locking arms press toward a corresponding holder in a direction which intersects a loading/unloading direction of the connector housings.

3. A connector housing positioning unit according to claim 1, further including:

a carrier member for carrying the mounting means; and a stationary member supporting the carrier member in such a manner that the carrier member is shiftable between a connector housing loading position and a terminal inserting position.

4. A connector housing positioning unit according to claim 1, wherein:

the mounting means includes a base plate which is displaceable between a connector housing loading/unloading position for loading/unloading the connector housings and a terminal inserting position for inserting terminals into the connector housings;

wherein the base plate includes a seat surface for sitting the connector housing thereon when the base plate is located in the connector housing loading/unloading position.

5. A connector housing positioning unit according to claim 4, wherein:

the holders of the holding means cooperate with the seat surface of the base plate for positioning the connector housing.

6. A connector housing feeding apparatus, comprising:

a supporting member; and a positioning unit supported by the supporting member, the positioning unit provided for positioning plural connector housings which are juxtaposed in a predetermined direction with spaces therebetween, wherein the connector housing positioning unit positions connector housings such that terminals fixed to ends of electric wires are inserted into the connector housings during manufacture of a wire harness, the connector housing positioning unit including:

holding means for holding the connector housings;

locking means for locking corresponding connector housings to the holding means;

shifting means for shifting the locking means between a clamping position for clamping the connector housings and a releasing position for releasing the connector housings, wherein the shifting means includes a common link member coupled with the locking means; and mounting means for feeding the connector housings to a terminal inserting mechanism, wherein the connector housing positioning unit integrally carries the holding means, the locking means and the shifting means.

7. A connector housing feeding apparatus according to claim 6, wherein the locking means includes plural locking arms and the holding means includes plural holders, wherein the locking arms press toward a corresponding holder in a direction which intersects a loading/unloading direction of the connector housings.

8. A connector housing feeding apparatus according to claim 6, further including:

a carrier member for carrying the mounting means, wherein the carrier member is supported by the supporting member in such a manner that the carrier member is shiftable between a connector housing loading position and a terminal inserting position.

9. A connector housing feeding apparatus according to claim 6, wherein the mounting means includes a base plate which is displaceable between a connector housing loading/unloading position for loading/unloading the connector housings and a terminal inserting position for inserting terminals into the connector housings; and wherein the base plate includes a seat surface for sitting the connector housing thereon when the base plate is located in the connector housing loading/unloading position.

10. A connector housing feeding apparatus according to claim 9, wherein the holding means includes plural holders cooperating with the seat surface of the base plate for positioning the connector housings.

11. A connector housing feeding apparatus according to claim 6, wherein the shifting means shifts locking members of the locking means along the predetermined direction by means of the common link member.

12. A connector housing feeding apparatus, comprising:

a supporting member; and a connector housing positioning unit supported by the supporting member, the connector housing positioning unit provided for positioning plural connector housings which are juxtaposed in a predetermined direction with spaces therebetween, wherein the connector housing positioning unit positions connector housings such that terminals fixed to ends of electric wires are inserted into the connector housings during manufacture of a wire harness, the connector housing positioning unit including:

holding means for holding the connector housings;

locking means for locking corresponding connector housings to the holding means;

shifting means for shifting the locking means between a clamping position for clamping the connector housings and a releasing position for releasing the connector housings; and mounting means for feeding the connector housings to a terminal inserting mechanism, wherein the connector housing positioning unit integrally carries the holding means, the locking means and the shifting means, wherein:

the holding means includes plural holders fixed to the mounting means along the predetermined direction;

the locking means includes locking arms placed in opposition to the respective holders along the predetermined direction; and the shifting means includes a common link member coupled with locking members of the locking means, wherein the shifting means shifts the locking members along the predetermined direction by means of the link member.

13. A connector housing feeding apparatus according to claim 12, wherein the locking arms press toward a corresponding holder in a direction which intersects a loading/unloading direction of the connector housings.

14. A connector housing feeding apparatus according to claim 12, further including:

a carrier member for carrying the mounting means, wherein the carrier member is supported by the supporting member in such a manner that the carrier member is shiftable between a connector housing loading position and a terminal inserting position.

15. A connector housing feeding apparatus according to claim 12, wherein the mounting means includes a base plate which is displaceable between a connector housing loading/unloading position for loading/unloading the connector housings and a terminal inserting position for inserting terminals into the connector housings; and wherein the base plate includes a seat surface for sitting the connector housing thereon when the base plate is located in the connector housing loading/unloading position.

16. A connector housing feeding apparatus according to claim 15, wherein the holders of the holding means cooperate with the seat surface of the base plate for positioning the connector housings.

* * * * *